US008464443B2

(12) United States Patent
Torgrimsen

(10) Patent No.: US 8,464,443 B2
(45) Date of Patent: Jun. 18, 2013

(54) FIXING DEVICE FOR A BUCKET FRONT

(75) Inventor: Tor Torgrimsen, Stavanger (NO)

(73) Assignee: Komatsu KVX LLC (NO)

( * ) Notice: Subject to any disclaimer, the term of this patent is extended or adjusted under 35 U.S.C. 154(b) by 0 days.

(21) Appl. No.: 13/579,361

(22) PCT Filed: Feb. 14, 2011

(86) PCT No.: PCT/NO2011/000052

§ 371 (c)(1),
(2), (4) Date: Oct. 4, 2012

(87) PCT Pub. No.: WO2011/102731

PCT Pub. Date: Aug. 25, 2011

(65) Prior Publication Data

US 2013/0025171 A1 Jan. 31, 2013

(30) Foreign Application Priority Data

Feb. 17, 2010 (NO) ..... 20100240

(51) Int. Cl.
*E02F 3/40* (2006.01)
*E01H 5/06* (2006.01)

(52) U.S. Cl.
USPC ..... 37/444; 172/701.3

(58) Field of Classification Search
USPC ..... 37/403–409, 443–450; 172/701.1, 172/701.3, 752; 414/724
See application file for complete search history.

(56) References Cited

U.S. PATENT DOCUMENTS

| | | | | | |
|---|---|---|---|---|---|
| 1,580,725 | A * | 4/1926 | Harrison | 37/448 |
| 1,757,328 | A * | 5/1930 | Mullally | 37/444 |
| 2,862,314 | A | 12/1958 | Larsen | |
| 4,043,060 | A * | 8/1977 | Stepe | 37/446 |
| 4,550,512 | A | 11/1985 | Felstet | |
| 4,729,180 | A * | 3/1988 | Hendricks | 37/450 |
| 5,253,449 | A * | 10/1993 | Webb et al. | 37/446 |
| 6,237,260 | B1 * | 5/2001 | Gooch | 37/398 |
| 2005/0172524 | A1 | 8/2005 | Grant | |

FOREIGN PATENT DOCUMENTS

WO 2007/098542 A1 9/2007

OTHER PUBLICATIONS

International Search Report for parent application PCT/NO2011/000052, having a mailing date of May 11, 2011.
Written Opinion for parent application PCT/NO2011/000052, having a mailing date of May 11, 2011.

* cited by examiner

*Primary Examiner* — Robert Pezzuto
(74) *Attorney, Agent, or Firm* — Andrus, Sceales, Starke & Sawall, LLP

(57) ABSTRACT

A fixing device is for a bucket front, wherein the bucket front forms a wear part in an excavating bucket comprising at least one side portion. The side portion is formed with a coupling piece comprising at least two projections with recesses, wherein the projections fit in a complementary manner into recesses in the bucket front or in a coupling part fixed to the bucket front, and wherein the bucket front is connected to the coupling piece by a locking bolt extending, in the direction of the side portion, through openings associated with the side portion and the bucket front.

3 Claims, 3 Drawing Sheets

III–III

FIXING DEVICE FOR A BUCKET FRONT

CROSS-REFERENCE TO RELATED APPLICATIONS

This application is the U.S. national stage application of International Application No. PCT/NO2011/000052, filed Feb. 14, 2011, which International application was published on Aug. 25, 2011 as International Publication No. WO 2011/102731 A1 in the English language and which application is incorporated herein by reference. The International application claims priority of Norwegian Patent Application No. 20100240, filed Feb. 17, 2010, which application is incorporated herein by reference.

This invention relates to a fixing device for a bucket front. More particularly, it relates to a fixing device for a bucket front, wherein the bucket front forms a wear part in an excavating bucket comprising at least one side portion.

In this context, an excavating bucket implies any form of bucket for excavating or loading, for example an excavator bucket or a shovel bucket.

Front pieces on excavating buckets are subjected to considerable wear. Even though a front piece may be provided with wear strips or similar protective material designed so as to extend the operating time of the front piece, it is necessary to carry out replacement of the front piece at various intervals.

According to the prior art, front pieces are oftentimes welded to the excavating bucket. Thus, it is relatively labour-intensive and hence expensive to remove the worn front piece, to prepare the excavating bucket and then to weld on a new front piece.

U.S. Pat. No. 4,550,512 discloses a bucket in which the bucket front is movable within side attachments. The bucket front is locked to the side attachments by means of bolts.

The bolts are utilized relatively poorly owing to the fact that only two share surfaces are subjected to a load.

The object of the invention is to remedy or reduce at least one of the disadvantages of the prior art.

The object is achieved in accordance with the invention and by virtue of the features disclosed in the following description and in the subsequent claims.

A fixing device for a bucket front is provided, wherein the bucket front forms a wear part in an excavating bucket comprising at least one side portion, wherein the fixing device is characterized in that the side portion is formed with a coupling piece comprising at least two projections with recesses, wherein the projections fit in a complementary manner into recesses in the bucket front or in a coupling part fixed to the bucket front, and wherein the bucket front is connected to the coupling piece by means of a locking bolt extending, in the direction of the side portion, through openings associated with the side portion and the bucket front.

By so doing, the bucket front may be connected to or disconnected from the side portion by moving the locking bolt within the openings.

The fixing device may be reinforced substantially by virtue of the locking bolt, which absorbs shear stresses in the fixing device, extending through several projections.

The coupling piece may be welded to the remaining part of the side portion, or it may form a part of the side portion.

The bucket front may comprise a coupling part engaged with the side portion. For example, the coupling part may be welded or bolted to the bucket front.

The locking bolt may be prevented from being moved out of the openings by means of a locking piece. Advantageously, the locking piece may be comprised of a wear strip, a cover or similar.

A fixing device for a front piece in accordance with the invention allows for a substantial simplification of the work of replacing the front piece on an excavating bucket. Upon having removed the locking bolt and having removed the worn front piece, immediately the excavating bucket is ready for mounting of a new front piece.

Hereinafter, an example of a preferred embodiment is described and depicted in the accompanying drawings, in which.

Figure 1:
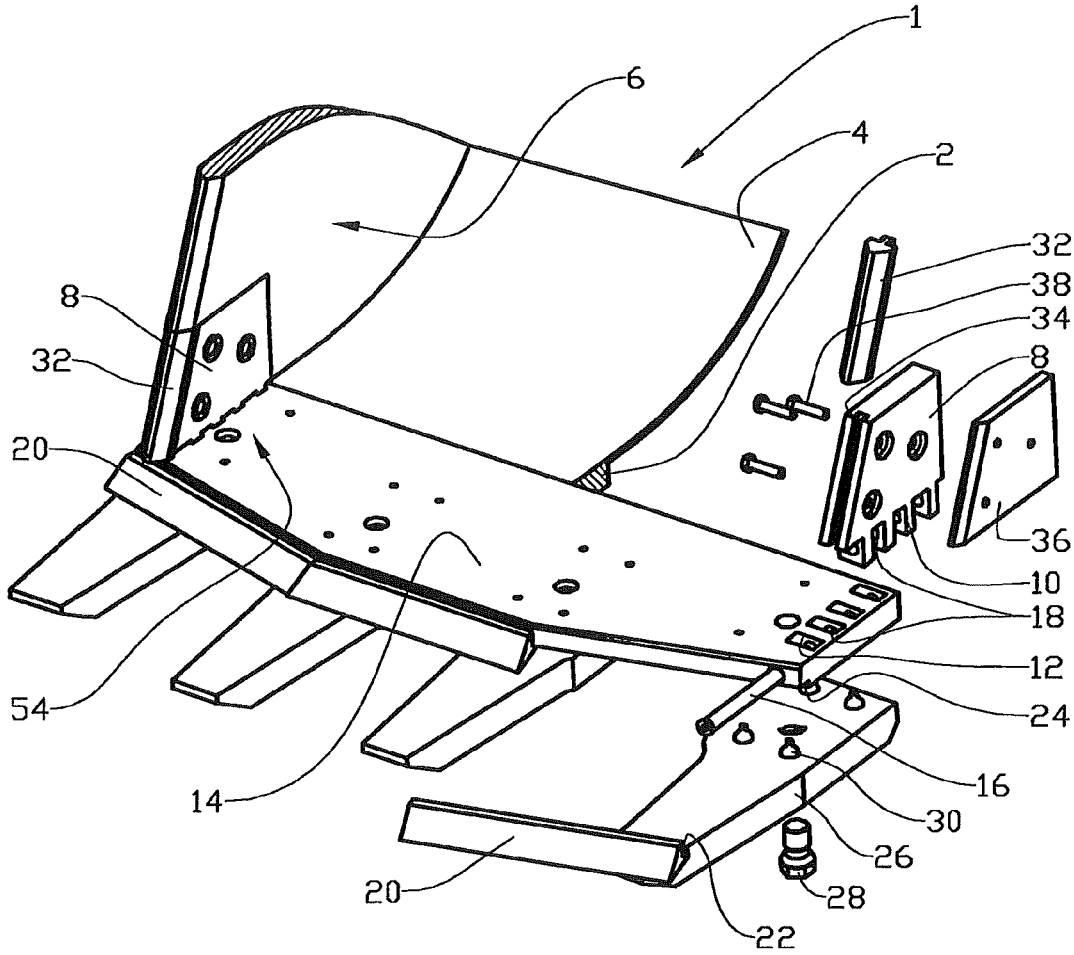
FIG. 1 shows, in perspective, a section of an excavating bucket formed with a fixing device in accordance with the invention, wherein components of the fixing device as well as additional components are shown in exploded view.

In the drawings the reference numeral 1 indicates an excavating bucket comprising a bottom beam 2 fixed to a bottom 4 of the excavating bucket 1 and to side portions 6 of the excavating bucket 1.

The side portions 6 are provided each with a coupling piece 8, the coupling pieces 8 being formed with projections 10 fitting in a complementary manner into recesses 12 in a bucket front 14. The coupling piece 8 may be formed as a part of the side portion 6.

A locking bolt 16 extends through openings 18 in the projections 10 of the coupling piece 8 and in the bucket front 14.

In this exemplary embodiment, the locking bolt 16 is prevented from being moved out of the openings 18 by virtue of a locking piece 20 in the form of a wear strip. A bulb 22 in the locking piece 20 is kept engaged within a groove 24 in the bucket front 14 by means of an excavating tooth 26 being clamped to the underside of the bucket front 14 by means of an excavating-tooth bolt 28. Ball guides 30 contribute to maintain the excavating tooth 26 in position underneath the bucket front 14.

A corner strip 32 fits into a T-groove 34 in the coupling piece 8, whereas a side cover 36 is attached to the coupling piece 8 by means of side cover bolts 38. The corner strip 32 and the side cover 36 are structured in a manner allowing them to protect the coupling piece 8 against wear.

When the bucket front 14 is to be mounted onto the excavating bucket 1, the bucket front 14 is moved into and around the projections 10 of the coupling piece 8. Then the locking bolt 16 is inserted into and through the openings 18 in the coupling piece 8 and in the bucket front 14.

Then the bulb 22 of the locking piece 20 may be placed into the groove 24, and the excavating tooth 26 may be fixed to the bucket front 14. Disassembling may be carried out in the reverse order, the locking bolt 16 being provided with a threaded extraction bore (not shown).

This embodiment is particularly suitable when the bucket front 14 is provided with underlying excavating teeth 26.

Figure 2:
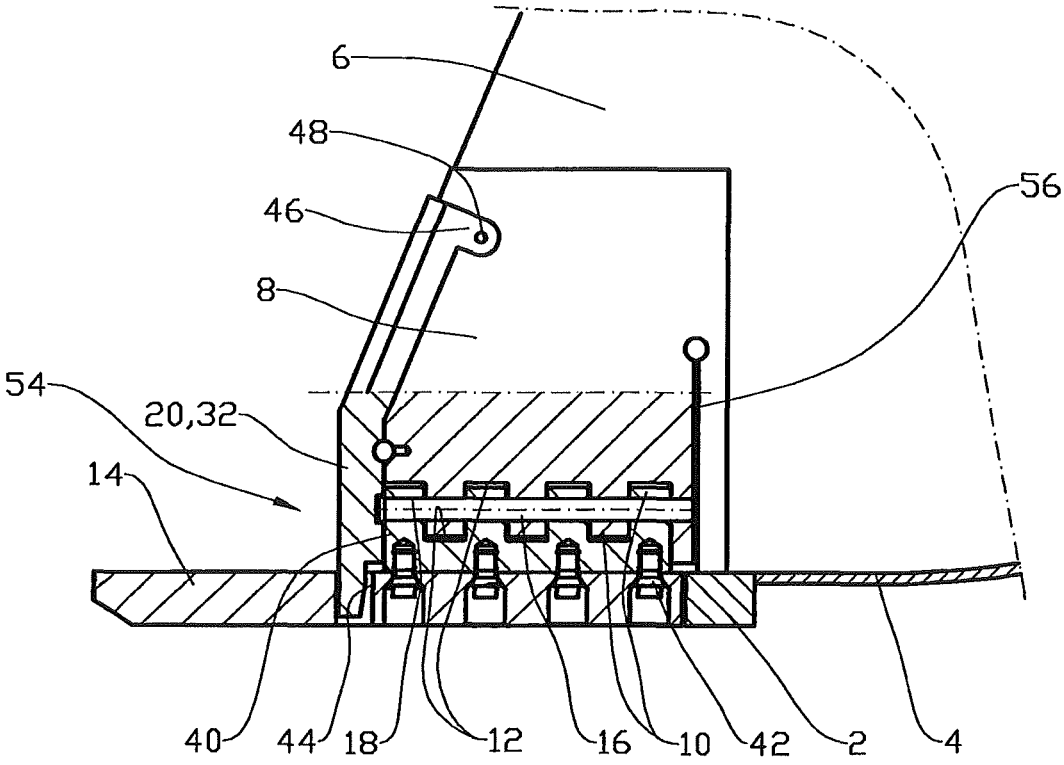
FIG. 2 shows, in larger scale and partial section, a fixing device of another embodiment.

In another embodiment, see FIG. 2, the bucket front 14 comprises a coupling part 40 fixed to the bucket front 14 by means of several coupling bolts 42. As with the coupling piece 8, the coupling part 40 is formed with projections 10 and recesses 12, the coupling piece 8 and the coupling part 40 fitting together in a complementary manner. The locking bolt 16 extends through the openings 18 in the projections 10.

In this embodiment, the locking piece 20 is comprised of a corner strip 32 projecting down into a strip recess 44 in the bucket front 14 and, an upper portion of the corner strip 32 being provided with an attachment fork 46 fixed to the coupling piece 8 by means of a through-going spring pin 48.

Figure 3:
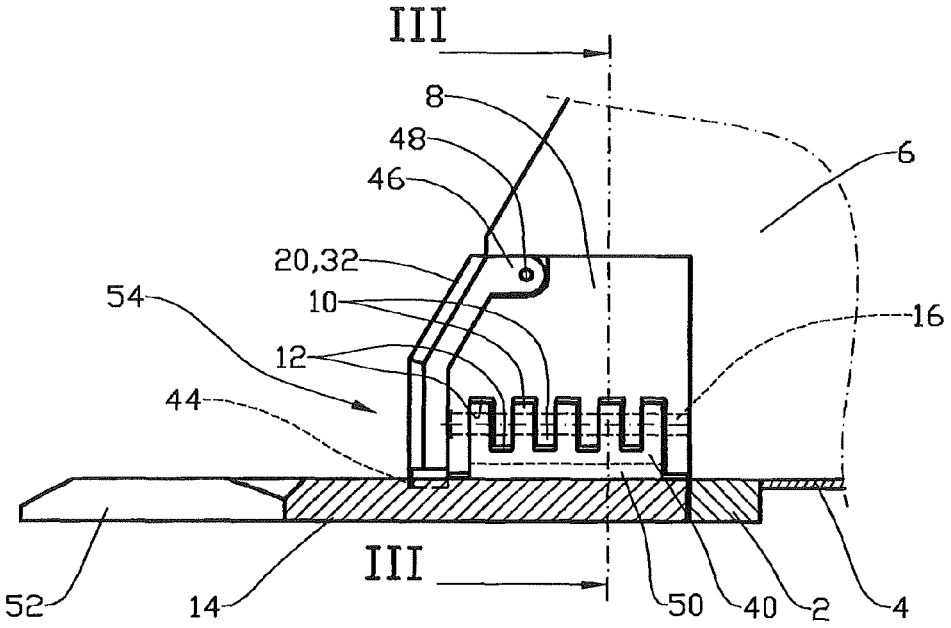
FIG. 3 shows the fixing device of a further embodiment.
Figure 4:
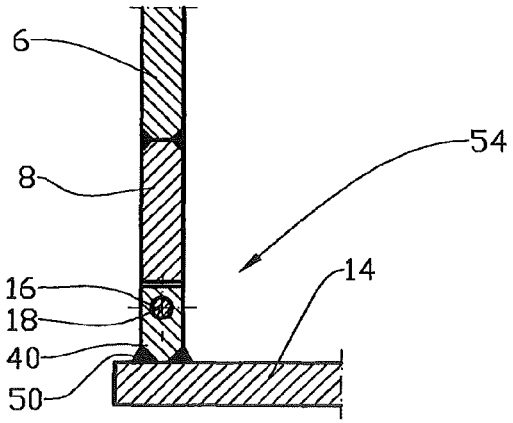
FIG. 4 shows a section of FIG. 3.

In a further embodiment, see FIG. 3, the coupling part 40 is fixed to the bucket front 14 by means of a welded joint 50.

Both of these alternative embodiments are particularly suitable when the bucket front 14 is profiled, for exampled by virtue of the bucket front 14 being formed with toothed portions 52.

Thus, a fixing device 54 in accordance with the invention comprises at least the side portion 6, the bucket front 14 and the locking bolt 16.

Excavating buckets 1 are generally in the form of a welded structure. When a side portion 6 comprises a coupling piece 8, advantageously the coupling piece 8 is welded to the side portion 6.

The coupling piece 8 is provided with a slit 56, see FIG. 2, extending from the side of the coupling piece 8 located near the projections 10 and inwards into the coupling piece 8 between the locking bolt 16 and the side portion 6.

The slit 56 is structured so as to allow for displacement of the distance between the locking bolts 16 at the two side portions 6 of the excavating bucket 1 when the bucket front 14 is subjected to loading and hence is deflected somewhat at the mid-portion thereof.

The somewhat springing function of the coupling pieces 8 substantially reduces the shear forces in the locking bolts.

The invention claimed is:

1. A fixing device for fixing a bucket from to an excavating bucket, the fixing device comprising:

a coupling piece engaged with a vertically extending sidewall of the excavating bucket, the coupling piece comprising a bottom surface having one of a plurality of projections and a complimentary plurality of recesses; wherein the other of the plurality of projections and plurality of recesses are formed in a top surface of the bucket front; and a locking bolt that couples the bucket front to the side portion by retaining the plurality of projections in the plurality of recesses;

wherein a first plurality of aligned openings are formed in the plurality of projections and wherein a second plurality of aligned openings are formed in the bucket front, wherein the first plurality of aligned openings are interdigitated and aligned with the second plurality of aligned openings when the plurality of projections are disposed in the plurality of recesses, and wherein the locking bolt extends through the first and second pluralities of aligned openings.

2. A fixing device for fixing a bucket front to an excavating bucket, the fixing device comprising:

a coupling piece that is coupled to a vertically extending sidewall of the excavating bucket, the coupling piece comprising a bottom surface having one of a plurality of projections and a complimentary plurality of recesses;

a coupling part that is coupled to and extends vertically upwardly from the bucket front, the coupling part comprising a top surface having the other of the plurality of projections and plurality of recesses; and a locking bolt that couples the coupling piece to the coupling part to thereby couple the bucket front to the sidewall, the locking bolt retaining the plurality of projections in the complimentary plurality of recesses.

3. The fixing device according to claim 2, comprising a corner strip projecting downwardly into a strip recess formed in the bucket front, the corner strip preventing the locking bolt from disengaging with the plurality of projections.

* * * * *